US006889870B2

(12) United States Patent
De Laforcade

(10) Patent No.: US 6,889,870 B2
(45) Date of Patent: May 10, 2005

(54) DEVICE FOR THE SIMULTANEOUS DISPENSING OF TWO SEPARATELY PACKAGED PRODUCTS

(75) Inventor: Vincent De Laforcade, Rambouillet (FR)

(73) Assignee: L'Oréal S.A., Paris (FR)

( * ) Notice: Subject to any disclaimer, the term of this patent is extended or adjusted under 35 U.S.C. 154(b) by 36 days.

(21) Appl. No.: 10/184,959

(22) Filed: Jul. 1, 2002

(65) Prior Publication Data

US 2003/0019883 A1 Jan. 30, 2003

(30) Foreign Application Priority Data

Jun. 29, 2001 (FR) ..... 01 08657

(51) Int. Cl.[7] ..... G01F 11/00; B65D 35/22

(52) U.S. Cl. ..... 222/1; 222/94; 222/103; 222/145.1

(58) Field of Search ..... 222/1, 94, 95, 222/103, 145.1

(56) References Cited

U.S. PATENT DOCUMENTS

| | | | | | |
|---|---|---|---|---|---|
| 5,188,256 | A | * | 2/1993 | Nottingham et al. | 222/1 |
| 5,322,194 | A | * | 6/1994 | Roberts | 222/103 |
| 5,425,475 | A | * | 6/1995 | Clark | 222/103 |
| 5,431,304 | A | * | 7/1995 | Gentile | 222/103 |
| 5,862,949 | A | | 1/1999 | Markey et al. | 222/143 |
| 6,019,251 | A | * | 2/2000 | Koga | 222/94 |
| 6,223,942 | B1 | * | 5/2001 | Markey et al. | 222/94 |

FOREIGN PATENT DOCUMENTS

| | | |
|---|---|---|
| CH | 690 234 | 6/2000 |
| DE | 297 17 244 | 1/1998 |
| EP | 0 238 878 | 9/1987 |
| EP | 0 407 320 | 1/1991 |
| FR | 2 647 093 | 11/1990 |
| GB | 2 322 114 | 8/1998 |
| JP | 43-4557 | 2/1968 |
| JP | 9-226785 | 9/1979 |
| JP | 56-16091 | 2/1981 |
| JP | 9-207952 | 8/1997 |
| JP | 2000-109145 | 4/2000 |
| WO | WO 94/19251 | 9/1994 |

OTHER PUBLICATIONS

Patent Abstracts of Japan, vol. 1998, No. 10, Aug. 31, 1999, JP 10 129681.

English language Derwent Abstract of CH 690 234, Jun. 15, 2000.

English language Derwent Abstract of EP 0 407 320, Jan. 9, 1991.

English language Derwent Abstract of FR 2 647 093, Nov. 23, 1990.

* cited by examiner

*Primary Examiner*—Joseph A. Kaufman
(74) *Attorney, Agent, or Firm*—Finnegan, Henderson, Farabow, Garrett & Dunner, L.L.P.

(57) ABSTRACT

A device for simultaneously dispensing at least two products is provided with each of the at least two products being packaged separately in at least first and second flexible-walled sachets. The device may comprise a holder configured to fixedly hold the first and second sachets in a superposed position so that respective outlet orifices of the first and second sachets are in the vicinity of one another, and a pressurizer movable with respect to the holder, the pressurizer being configured to apply pressure to the first and second sachets so as to force contents of the first and second sachets out through the respective outlet orifices in a predetermined ratio. A system and method associated with the device are also provided.

74 Claims, 5 Drawing Sheets

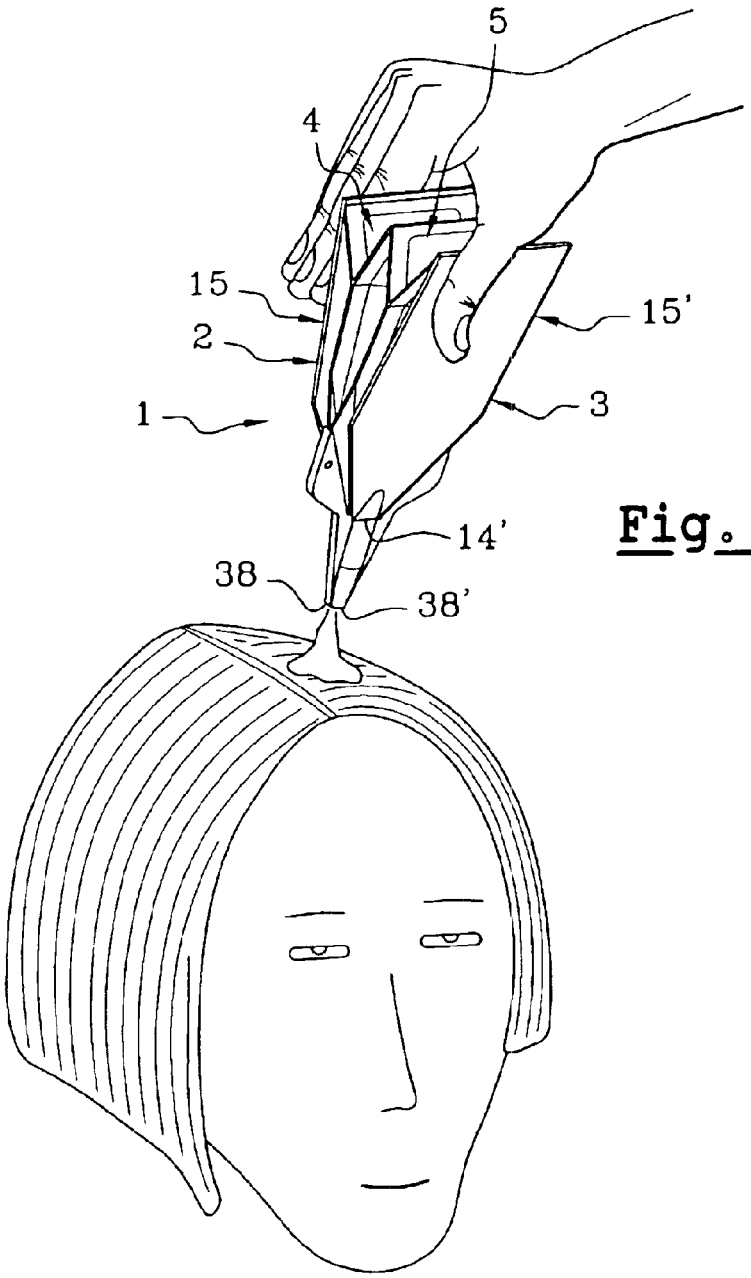
Fig. 5B
Fig. 5C
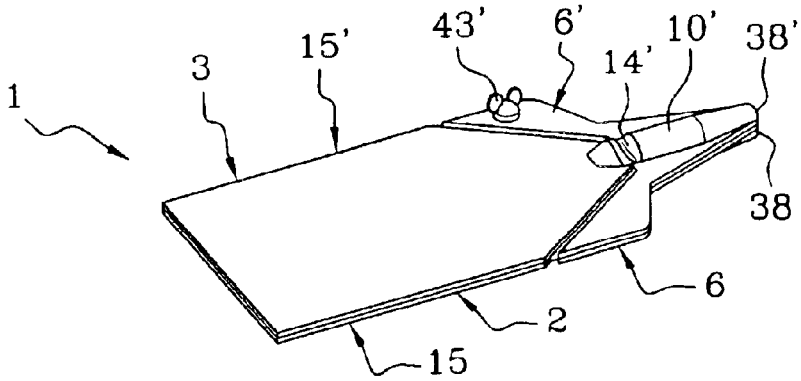

DEVICE FOR THE SIMULTANEOUS DISPENSING OF TWO SEPARATELY PACKAGED PRODUCTS

The present invention relates to a device for the joint dispensing of at least two products packaged separately in flexible-walled packaging in the form of sachets. A device such as this may be suited for dispensing products that may be combined to form a cosmetic composition, such as, a hair composition, for example one based on a dye and an oxidizer.

DESCRIPTION OF THE RELATED ART

In the field of hair coloring, for example oxidation coloring entailing the extemporaneous mixing of a dye and of an oxidizer, multiple products that are to be mixed may be packaged, so that each of the products is in its own tube or each of the products is in its own bottle. Alternatively, the products could be packaged so that one product (e.g., dye) is in a tube and another product (e.g., oxidizer) is in a bottle.

More sophisticated systems, which are being used increasingly less, make it possible, somewhat automatically, through a simple turn or press action, to mix the two products packaged in separate bottles so that they can be applied to the hair.

None of these systems is without its drawbacks. In some, the cost may be relatively high and therefore incompatible with the dictates of large distribution chains. Furthermore, the reliability may not be always sufficient. In others, the action may be complicated, and in others it may be difficult for the two products to be dispensed in a predetermined ratio, which sometimes may mean that the result, in terms of the color obtained, may not correspond to that which was expected.

EP-A 0 407 320 describes a system for extruding the contents of a package, the system being configured in the form of a V-shaped clip operated by the user and equipped to have a package placed between the two legs of the V. Because of its configuration, such a system may be suited only to the emptying of slim packages. In addition this device is not suitable for dispensing of products from multiple packages.

CH-A5-690 234 describes a packaging device and a flexible pack consisting of a tubular sleeve having a polygonal cross section defined by a wall consisting of rigid plates articulated together by their longitudinal edges. Due to the packs being connected to one another along their longitudinal edges, such a device is not suitable to allow open portions of the packs to be in the same vicinity. Also, it may be difficult to exert identical pressure on both packs. As a result, two products could not easily be dispensed in a predetermined ratio.

Furthermore, according to the two documents just discussed hereinabove, there is no fixing structure to hold the packages in a fixed position with respect to the pressurizing structure.

SUMMARY

The present invention relates to a device that may optionally address at least one or more of the drawbacks associated with conventional devices.

Another aspect may be to provide such a device that is simple to use and of advantageous cost.

Another aspect may be to provide a device that can allow the joint dispensing of two separately packaged products, and to do so in a predetermined ratio of one of the products with respect to the other.

Yet another aspect may be to produce such a device that allows the joint dispensing of at least two products sufficiently locally for the two products to be able to be brought into contact with one another substantially at the point where they are applied.

Aspects of the invention will appear in more detail in the description that follows. In addition, the following description includes a discussion of a few possible embodiments of the invention. It should be understood that the aspects and embodiments described herein are merely exemplary and that the invention could be practiced without having all of the features of these aspects and embodiments.

According to one aspect, there is a device for the simultaneous dispensing of at least two products, packaged separately in first and second flexible-walled sachets, the device comprising a holder configured to fixedly hold the two sachets in a superposed position so that respective outlet orifices of the sachets are in the vicinity of one another, and a pressurizer movable with respect to the holder and being configured to pressurize the two sachets in such a way as to force their contents out through their respective outlet orifices in a predetermined ratio.

In some embodiments, the two products may be packaged in the form of sachets, which may make it possible to appreciably reduce the cost associated with packaging them. One example of a sachet includes a package made of two superposed flexible sheets joined along at least a portion of their perimeters to create a reservoir capable of containing a product. For example, such a sachet could be similar to the form of a sugar packet or a shampoo sample package. Some embodiments of the sachet may have a portion, such as an outlet orifice, capable of being opened, for example by puncturing, tearing, breaking, tearing, etc., to allow the product contained in the reservoir to be dispensed from the sachet. According to the viscosity of the product and the size of the respective outlet orifices of the sachets, for example, it may be possible, by appropriately configuring the pressurizer, to obtain a ratio for the dispensing of the two products which may be as close as possible to the desired ratio. Furthermore, the action involved may be relatively simple.

In some embodiments, the pressurizer may comprise at least two plates, each plate being articulated with respect to the holder about an axis roughly perpendicular to a longitudinal axis X of the device. A configuration such as this may allow the device to be used for sachets of relatively large volume, such as sachets whose maximum thickness may be on the order of one centimeter or more, for example.

In one embodiment, the two plates may be arranged with one facing the other, each plate being delimited by two longitudinal edges, the longitudinal edges of the first plate being, over the entirety of their length, a variable distance away from the corresponding edges of the second plate. Some exemplary forms of that embodiment may have the ability to be used for sachets of greater capacity and may also be capable of providing substantially identical pressurizing of the two sachets, so as to encourage their respective contents to be dispensed in a predetermined ratio.

In one embodiment, each plate may comprise a first end situated in the vicinity of the outlet orifices, and a second end at the opposite end to the first, the first end being adjacent to the articulation axis.

In one aspect, the sachets may be opened by at least one of cutting, tearing, and breaking an end portion of the sachets.

In another aspect, the plates may be arranged symmetrically on each side of a mid-plane situated at an interface between the two superposed sachets which they flank, a first end of the plates, which end may be situated in the vicinity of the outlet orifices, being coupled to the holder via an articulation axis, a second end of the plates, at the opposite end to the first, being free so that bringing the second ends of the plates closer together causes the sachets to be pressurized identically.

In some embodiments, two substantially identical plates may be held symmetrically on each side of the stack of the two sachets. This may make it possible, for products of substantially identical viscosity, for example, and for outlet orifices of identical cross-sectional area, to dispense the two products in a ratio, which may be 1:1. If a different ratio is desired, one option may be for the relative viscosities of the two products and/or the relative cross-sectional areas of the outlet orifices of the sachets to be altered.

In some embodiments, the aforementioned symmetry may allow for substantially identical pressurizing of the sachets, which may also be obtained with more than two sachets. It may be possible to provide a third sachet arranged between the first two and containing, for example, a perfume. A third sachet such as this could be of significantly smaller volume and could have an outlet orifice of smaller cross sectional area than the cross-sectional area of the outlet orifices of the other two sachets.

In one aspect, the two plates may be obtained from two substantially similar moldings, which may be made of, for example, polypropylene.

In another aspect, the device may be configured in such a way as to be able to rest freely on a roughly horizontal support with the outlet orifices some distance from the support. Thus, when the device is thus resting on such a support, the products may not run out inadvertently.

According to another aspect, the device may be configured so as to be able to rest roughly vertically on the support. Such a configuration can be obtained by causing the device to rest on the free ends of the pressurizing plates, which act as legs.

According to one embodiment, the device may comprise a first element comprising a first fixing part and a first pressurizing plate that moves with respect to the first fixing part in a direction transverse to a mean plane of the first plate, a second element comprising a second fixing part and a second pressurizing plate that moves with respect to the second fixing part in a direction transverse to a mean plane of the second plate; and a fastener (e.g. catching structure) configured to hold the first and second sachets in a superposed position between the first and second elements, a main face of the first sachet being, at least in part, opposite an internal face of the first pressurizing plate, a main face of the second sachet, situated on the opposite side to the main face of the first sachet being, at least in part, opposite an internal face of the second pressurizing plate.

In certain embodiments, when the sachets are in position between the first and second elements, an end portion of the sachets may continue beyond the first and second fixing parts so as to allow it to be torn, cut or broken, for example. Thus, the sachets may be opened after the sachets have been positioned on the device, which may prevent any of either of the products from escaping while the sachets are being put in place.

According to one aspect, the sachets may be opened by hand, for example by tearing the end portions thereof. Alternatively (or additionally), the use of a tool such as a pair of scissors may be employed.

In some embodiments, when sachets are in an the assembled position, first and second fixing parts that define at least part of the holder may form an end-piece directed along an axis X of the device and may allow localized application of the two products. Thus, the end-piece may allow the products to leave side by side, the products being brought into contact directly at the point to which they are applied.

According to one aspect, one and/or another of the first and second fixing parts may form, on at least part of the length of the end-piece, an axial bulge. Each of the sachets may delimit an outlet duct opening, on the one hand, into the outlet orifice and, on the other hand, into a larger-width portion forming a reservoir. Thus, the axial bulge(s) may facilitate the communication between the outlet orifices of the sachets and their respective reservoirs via their respective outlet ducts.

According to another aspect, when the device is in the assembled position, the first and second pressurizing plates may be able to pivot with respect to the first and second fixing parts, respectively, about an articulation region. The articulation region may be in the form of a living hinge, for example, oriented roughly at right angles to a longitudinal axis X of the device. Some embodiments configured in that way make it easier to exert identical pressure on both sachets.

In certain embodiments, the articulation regions of the first and second elements may be delimited along the perpendicular to the axis X by first ends of two cuts running at an angle as far as second ends opening onto respective longitudinal edges of the first and second elements.

In one aspect, the fastener may allow the sachets to be assembled reversibly on the device. The assembly may be achieved by screwing or reversible snap-fastening, for example. Such a configuration may allow for removal of the sachets once their contents have been dispensed. The device may then be rinsed to clean it, and may be kept to be used again. It also may be possible to envisage marketing the sachets independently of the remainder of the device.

In an alternative aspect, the fastener may allow the sachets to be assembled irreversibly on the device. Such irreversible assembly may be obtained by bonding, welding, irreversible snap-fastening, or by a system of the rivet type, for example.

According to one embodiment, the fastener may comprise at least one element, such as in the form of a screw, of a barbed system, or of a rivet, for example, passing through fixing holes formed in the first and second sachets and in one and/or other of the first and second fixing parts. The holes may be capable of being placed in register with each other.

In one aspect, the at least one fastener may be secured to one and/or the other of the first and second fixing parts. The fasteners may be obtained by molding with the fixing part to which they are secured, for example.

In one aspect, such as catching by snap-fastening, the fastening may result from the collaboration of a portion of the fastener of the first fixing part with a complementary portion formed directly by the second fixing part.

In an alternative aspect, catching may result from the collaboration of a portion of the fastener of the first fixing part with a member distinct from the second fixing part, for example a nut.

According to yet another alternative aspect, fastening may result from the collaboration of two elements distinct from the first and second fixing parts (e.g. rivet, screw/nut, etc).

According to one aspect, the first and second sachets and the first and second fixing parts may each form two shoulders situated one on each side of a longitudinal axis X of the device, the device comprising at least one fastener on each side of the axis X, at each of the shoulders.

As an alternative aspect, each of the fixing parts may be secured to at least one fastener. Thus, it may possible to provide at least one first fastener on a shoulder of one of the fixing parts and at least one second fastener, identical to the first, on the same shoulder of the other of the fixing parts. This may then make it possible, when the two fixing parts are arranged with their internal faces facing each other, for there to be at least one fastening on each of the shoulders. As a result of this arrangement, some embodiments of the device may comprise two elements that may be obtained from two substantially identical moldings, thus reducing the cost of molding the constituent elements of the device accordingly.

In certain embodiments, at least prior to opening the outlet orifices, for example by tearing, cutting, or breaking, the first and second pressurizing plates may diverge in a direction away from the outlet orifices with a free end of the pressurizing plates extending beyond the bottom of the first and second sachets. This may make it possible, as mentioned earlier, to stand the device in a vertical position on a horizontal surface.

In one aspect, each of the sachets may comprise two sheets each delimiting a main face of the sachet, and an end sheet forming a bottom. Such a configuration may allow a harmonious opening of the pouch in the form of a triangle, the vertex of the triangle being in the vicinity of the outlet orifices. Such a configuration may facilitate the divergent arrangement of the pressurizing plates. This divergent arrangement may give the device good stability when standing vertically on a support.

In another aspect, at least one of the first and second sachets may be formed of a complex of aluminum and of a plastic that can be thermally welded to itself.

In certain embodiments, the device may be suited for the simultaneous dispensing of at least two products with a view to forming a cosmetic composition, for example a hair composition.

In one aspect, a device for simultaneously dispensing at least two products is provided. Each of the at least two products may be packaged separately in at least first and second flexible-walled sachets. The device may comprise a holder configured to fixedly hold the first and second sachets in a superposed position so that respective outlet orifices of the first and second sachets are in the vicinity of one another. The device may also comprise a pressurizer movable with respect to the holder, the pressurizer being configured to apply pressure to the first and second sachets so as to force contents of the first and second sachets out through the respective outlet orifices in a predetermined ratio.

In another aspect, the pressurizer may comprise at least two plates. The at least two plates may be configured to articulate about an articulation axis with respect to the holder. In addition, the articulation axis may be substantially perpendicular to a longitudinal axis of the device.

In another aspect, the at least two plates may substantially face one another and each may be delimited by at least a pair of longitudinal edges. The device may be configured so that the longitudinal edges of one of the two plates extend, over the entirety of their length, at a variable distance, or in a diverging manner, from corresponding longitudinal edges of the other of the at least two plates.

In yet another aspect, each of the plates may comprise a first end and a second end opposite to the first end, the first end being configured to be located in the vicinity of the outlet orifices and the first end being located adjacent the articulation axis. Each of the two plates may be coupled to the holder via an articulation region at the articulation axis. The two plates may also be coupled to the holder via a living hinge, which may be perpendicular to the longitudinal axis.

According to another aspect, the second end of each of the two plates may be free.

According to yet another aspect, the two plates may be arranged substantially symmetrically on each side of a mid-plane of the device.

In another aspect, the two plates may be substantially similar. This substantial similarity may be derived from the two plates being made from the same mold or substantially similar molds.

In one aspect, the holder may comprise two fixing portions.

In a further aspect, the device may comprise at least one fastening element configured to fasten the first and second sachets between the two fixing portions. The at least one fastening element may be configured to reversibly or irreversibly fasten the first and second sachets between the two fixing portions. The at least one fastening element may comprise at least one of a screw, a barbed element, and a rivet.

According to certain embodiments, the at least one fastening element may comprises two fastening elements and each of the fixing portions may define a hole through which a corresponding one of the two fastening elements is configured to pass. The two fastening elements may be configured to pass through corresponding holes in each of the first and second sachets.

In another aspect, each of the two fastening elements may be located on opposite sides of a central longitudinal axis of the device.

In yet another aspect, the at least one fastening element may be secured to one of the two fixing portions.

In another aspect, each of the two fastening elements may be secured to a corresponding one of the two fixing portions.

In another aspect, each of the two plates may comprise a portion of an end-piece extending along a longitudinal axis of the device. The end-piece may be configured to convey product from each of the first and second sachets to a desired location. Further, one of the two plates may comprise, on at least one part of the length of the end piece, an axial bulge.

Another aspect relates to a system for simultaneously dispensing at least two products. The system may comprise a device as described herein and at least first and second flexible-walled sachets fixedly held by the holder. Each of the at least first and second sachets may further be configured to be opened by at least one of cutting, tearing, and breaking a respective end portion of each sachet.

In another aspect, the pressurizer may comprise first and second pressurizing plates between which the at least first and second sachets are superposed. The first and second pressurizing plates may be arranged substantially symmetrically on each side of a mid-plane situated at an interface between the at least first and second sachets.

In another aspect, each of the at least first and second sachets may comprise a respective outlet orifice, wherein a first end of each of the first and second pressurizing plates, in the vicinity of said outlet orifices, is coupled to the holder via an articulation region. Additionally, a second end of each of the first and second pressurizing plates, opposite the first end of each of said first and second plates, may be free such that the second end of each of said first and second plates is movable to bring the first and second plates closer together to pressurize the first and second sachets in a substantially equal manner.

In another aspect, each of the at least first and second sachets may comprise a respective outlet orifice, and the system may be configured to rest freely on a substantially horizontal support with said outlet orifices a distance from said horizontal support. The system may be configured to rest substantially vertically on said support.

In another aspect, each of the at least first and second sachets may comprise an end portion configured to extend beyond the holder.

In one aspect, each of the at least first and second sachets may comprise two sheets, each sheet delimiting a respective sachet main face. Each of the at least first and second sachets may further comprise a third sheet forming a sachet bottom.

According to another aspect, at least one of the at least first and second sachets may comprise a complex of aluminum and a plastic capable of being thermally welded to itself.

In another aspect, each of the first and second sachets may contain a component of a cosmetic composition. For example, the cosmetic composition may comprise a hair composition.

Another aspect relates to, a method of dispensing at least two products. The method may comprise providing a dispensing system as substantially described herein and pressurizing each of the first and second sachets to cause a first product to flow from the first sachet and a second product to flow from the second sachet.

The term "providing" is used broadly, and refers to, but is not limited to, making available for use, giving, supplying, obtaining, getting a hold of, acquiring, purchasing, selling, distributing, possessing, making ready for use, and/or placing in a position ready for use.

According to another aspect, the first and second products may be combined to form a cosmetic composition, for example a hair product. The hair composition, which may be a hair dying composition, for example, may then be applied to hair.

According to another aspect, the pressurizing may comprise pressing at least one pressurizing plate to exert pressure on the first and second sachets. The pressurizing may also comprise moving a free end of a first pressurizing plate closer to a second pressurizing plate to exert pressure on the first and second sachets.

According to another aspect, there a device that may include a first element comprising a first fixing part and a first pressurizing plate movable with respect to the first fixing part in a direction transverse to a mean plane of the first plate, a second element comprising a second fixing part and a second pressurizing plate movable with respect to the second holding part in a direction transverse to a mean plane of the second plate, and at least one fastening element configured to fixedly hold the first and second sachets in a superposed position between the first and second elements.

In another aspect, the device may be configured so that a main face of the first sachet contacts an internal face of the first pressurizing plate and a main face of the second sachet, opposite the main face of the first sachet, contacts an internal face of the second pressurizing plate.

In another aspect, the device may be configured so that when the sachets are in position between the first and second elements, an end portion of each of the sachets extends beyond the first and second fixing parts to allow the sachets to be opened.

In yet another aspect, the first and second fixing parts may form an end-piece directed along a longitudinal axis of the device. The end-piece may be configured to allow application of product contained in the sachets to a desired location. Further, at least one of the first and second fixing parts may form, on at least part of the length of the end piece, an axial bulge.

According to a further aspect, each of the sachets may delimit an outlet duct opening on one end to an outlet orifice and on another end into a larger width portion forming a sachet reservoir. Additionally, the axial bulge may be configured to facilitate communication between the outlet orifices of the sachets and their respective reservoirs via their respective outlet ducts.

In another aspect, the first and second pressurizing plates may be pivotable with respect to the first and second fixing parts, respectively, about an articulation region. The articulation region may be oriented approximately perpendicular to a longitudinal axis of the device.

In yet another aspect, the articulation region of each of the first and second elements may be delimited by first and second cuts in the first and second elements, respectively. In addition, the first and second cuts of each of the first and second elements may extend at an angle with respect to an articulation axis defined by the articulation region and with respect to the longitudinal axis. Further, the first and second cuts may open onto respective longitudinal edges of the first and second elements.

In another aspect, the at least one fastening element may passes through holes defined by the sachets and by at least one of the first and second fixing parts. The device may also be configured such that the holes defined by the sachets and the at least one fixing part are configured to be aligned with one another.

In yet another aspect, the at least one fastening element may be fixedly attached to at least one of the first and second fixing parts.

According to another aspect, the device may be configured such that the first and second sachets and the first and second fixing parts each form two shoulders, one shoulder situated on each side of a longitudinal axis of the device, and wherein at least one fastening element is located on each side of the longitudinal axis at each of the shoulders.

In another aspect, at least one fastening element may be fixedly attached to the first fixing part and at least one fastening element may be fixedly attached to the second fixing part.

In another aspect, the device may be configured so that, at least prior to opening outlet orifices of the sachets, the first and second pressurizing plates diverge from each other in a direction away from the outlet orifices.

In another aspect, a free end of each of the pressurizing plates may extend beyond a bottom of the first and second sachets.

BRIEF DESCRIPTION OF THE DRAWINGS

The accompanying drawings are included to provide a further understanding of the invention and are incorporated in and constitute a part of this specification. The drawings illustrate at least one exemplary embodiment of the invention and, together with the description, serve to explain certain principles. In the drawings.

FIGS. 5A–C illustrate the various stages in the use of a device as depicted in the preceding figures.

DESCRIPTION OF EXEMPLARY EMBODIMENTS

Figure 1:
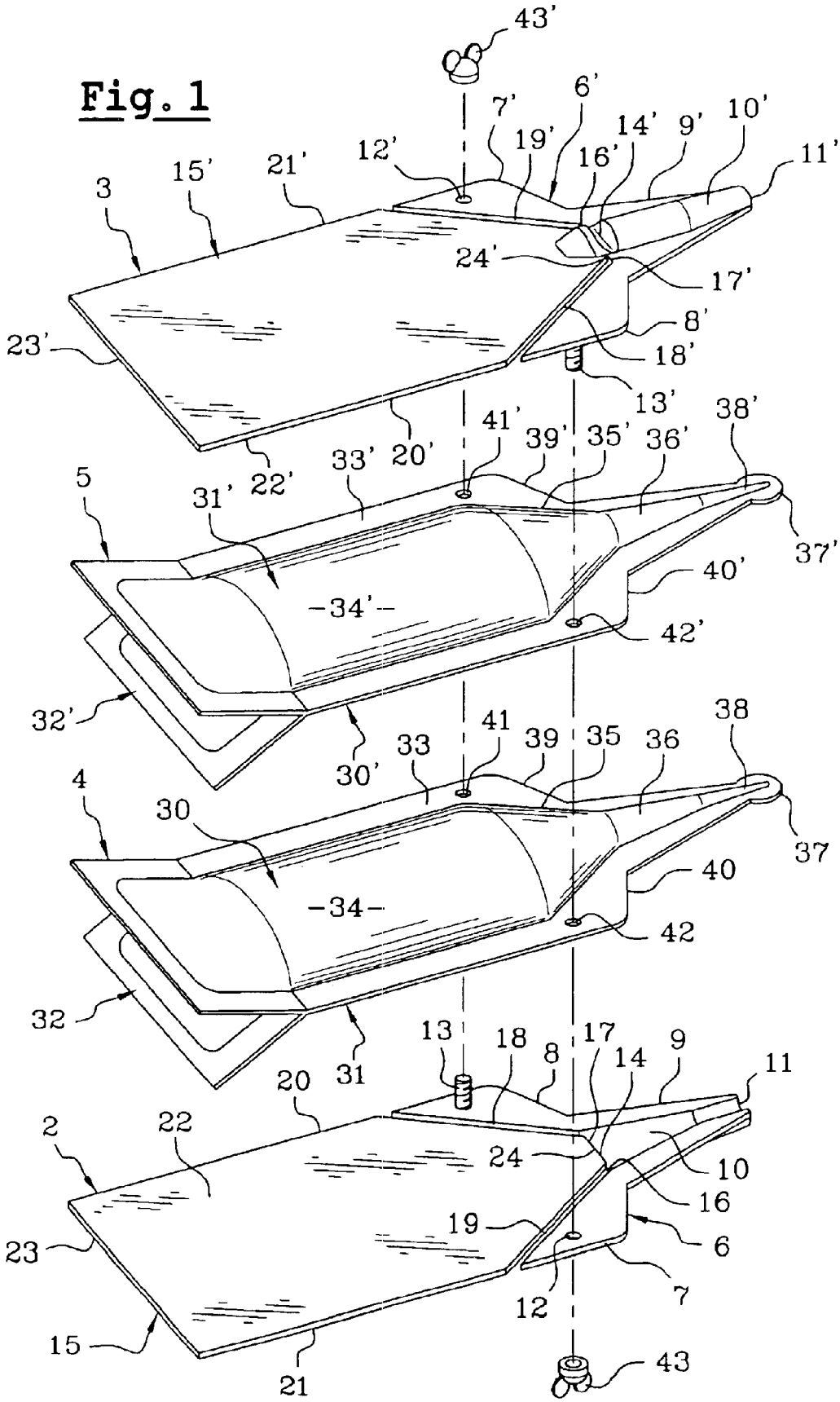
FIG. 1 is an exploded view of an embodiment of the dispensing device.

Reference will now be made in detail to an exemplary embodiment illustrated in the accompanying drawings. Wherever possible, the same reference numbers are used in the drawings and the description to refer to the same or like parts, and the same reference numbers with alphabetical suffixes or numerical prefixes are used to refer to similar parts.

The device 1 illustrated in FIGS. 1, 2A–2B, 3 and 4 comprise two substantially similar elements 2 and 3, between which two identical sachets 4 and 5 are arranged. The sachet 4 may contain, for example, a dye and the sachet 5 may contain, for example, an oxidizer, which may be used for preparing a hair coloring composition, for example. Elements 2 and 3 may be formed by molding out of the same mold.

The first element 2 may be configured in the form of an element of roughly flat shape. It comprises a fixing part/portion 6 defining two shoulders 7 and 8 connected by a transverse shoulder to a portion of elongate shape 9 hollowed axially to more or less define a hollow half-cylinder 10 open at its free end 11.

One of the shoulders 7 of the element 2 is pierced with a hole 12. On the other shoulder 8, symmetrically with respect to a longitudinal axis of the element 2, a threaded shank 13 protrudes from the interior surface 22 of the element 2.

At its opposite end to the free end 11, the hollow half-cylinder 10 is connected via a living hinge 14 to one end 24 of a pressurizing plate 15. The living hinge 14 is located at an articulation region of the element and may define an articulation axis about which plate 23 may pivot with respect to fixing part 6. The length of the living hinge is delimited by the ends 16 and 17 of two cuts 18 and 19 running at an angle as far as the longitudinal edges 20, 21 of the element 2.

Thus, the plate 15 can pivot with respect to the fixing part 6 about an axis perpendicular to a longitudinal axis of the element 2 and defined by the living hinge 14.

The device according to this embodiment comprises a second element 3, substantially similar to the first element 2 and the internal surface 22' of which is intended to face the internal surface 22 of the element 2. For reasons of simplicity of the text, the element 3 will not be described again. In the drawing, the same numerical references as those used for the element 2, but with a "prime" added, have been used.

The device, in one embodiment, also includes a first sachet 4 containing a first product and a second sachet 5 containing a second product, distinct from the first.

Figure 2A:
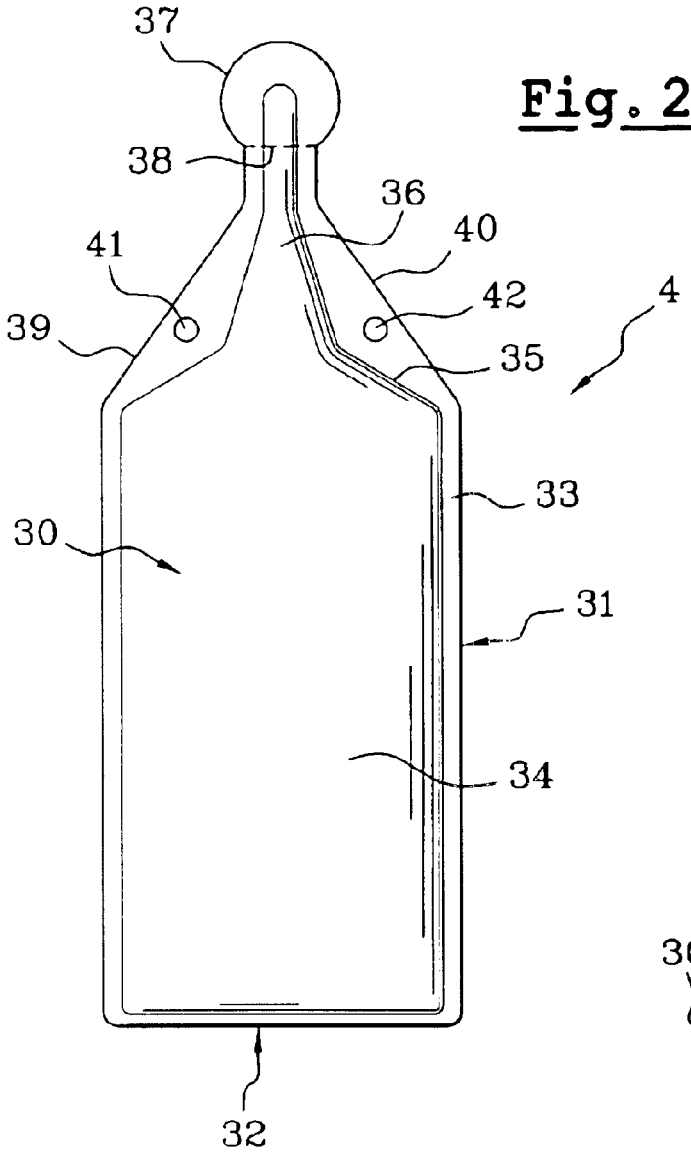
FIGS. 2A and 2B are a front view and a simplified side view, respectively, of a sachet that can be used in the device of FIG. 1.
Figure 2B:
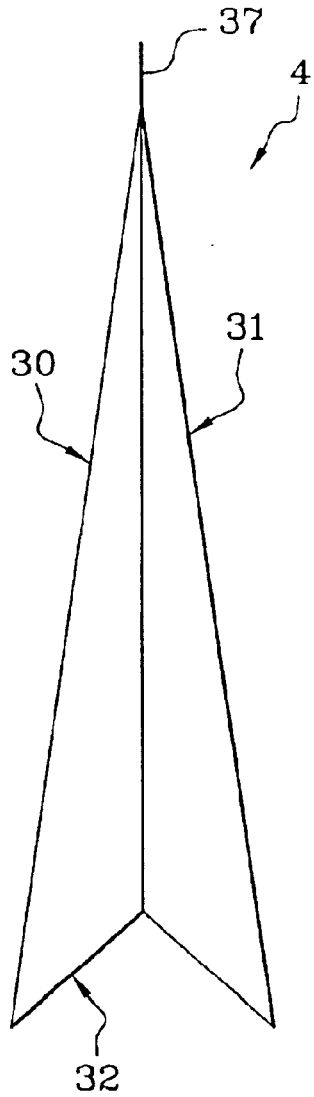

As depicted in greater detail in FIGS. 2A–2B, the sachet 4 has more or less the same shape as the elements 2 and 3 which have just been described. It is formed by the superposition of two sheets 30, 31 that may be made of a complex based on aluminum and on thermoplastic, which can be thermally welded to itself. An end sheet 32, which may be made of the same material, forms the bottom of the sachet, giving it some volume.

The peripheral weld regions 33 of the sheets 30, 31 delimit a wider part 34 forming a reservoir separated by a shoulder 35 from an axial outlet passage 36 ending at an end portion 37. By tearing, or otherwise breaching the portion 37, the outlet passage 36 can be placed in communication with the outside via an opening 38 situated more or less at the point where the end portion 37 and the remainder of the sachet 4 meet.

The sachet 4, on each side of its longitudinal axis, forms two shoulders 39, 40 at which the sheets 30 and 31 are thermally welded. Holes 41, 42, arranged symmetrically with respect to the axis of the sachet, are formed in the shoulders 39 and 40 respectively.

The sachet 5 is substantially similar to the sachet 4 in construction, but as mentioned above may contain the same or a different product. To make the text simpler, it will not be described again. In the drawing, the sachet 5 has the same numerical references as the sachet 4, with a "prime" added.

To assemble the assembly, the elements 2 and 3 and the sachets 4 and 5 may be arranged as illustrated in the exploded view of FIG. 1. The fixing parts 6 and 6' may together define an exemplary holder for fixedly holding the sachets 4 and 5.

A first sachet 4 may be arranged on the lower plate 2, inserting the threaded shank (fastening/fastener) 13 into the hole 41 and positioning the hole 42 of the sachet so that it faces the hole 12 formed on the shoulder 7 of the element 2.

The same may be done with the sachet 5.

Next, the element 3 may be brought over the stack thus produced, bringing the internal surface 22' of the element 3 to face the internal surface 22 of the element 2. The threaded shank 13' of the element 3 may be made to pass through the hole 42' of the sachet 5, the hole 42 of the sachet 4, and the hole 12 of the element 2. In the same way, the threaded shank 13 of the element 2 may be made to pass through the hole 41 of the sachet 4, the hole 41' of the sachet 5, and the hole 12' of the element 3. A nut 43, 43' may be screwed onto the free end of each of the threaded shanks 13, 13'.

Figure 3:
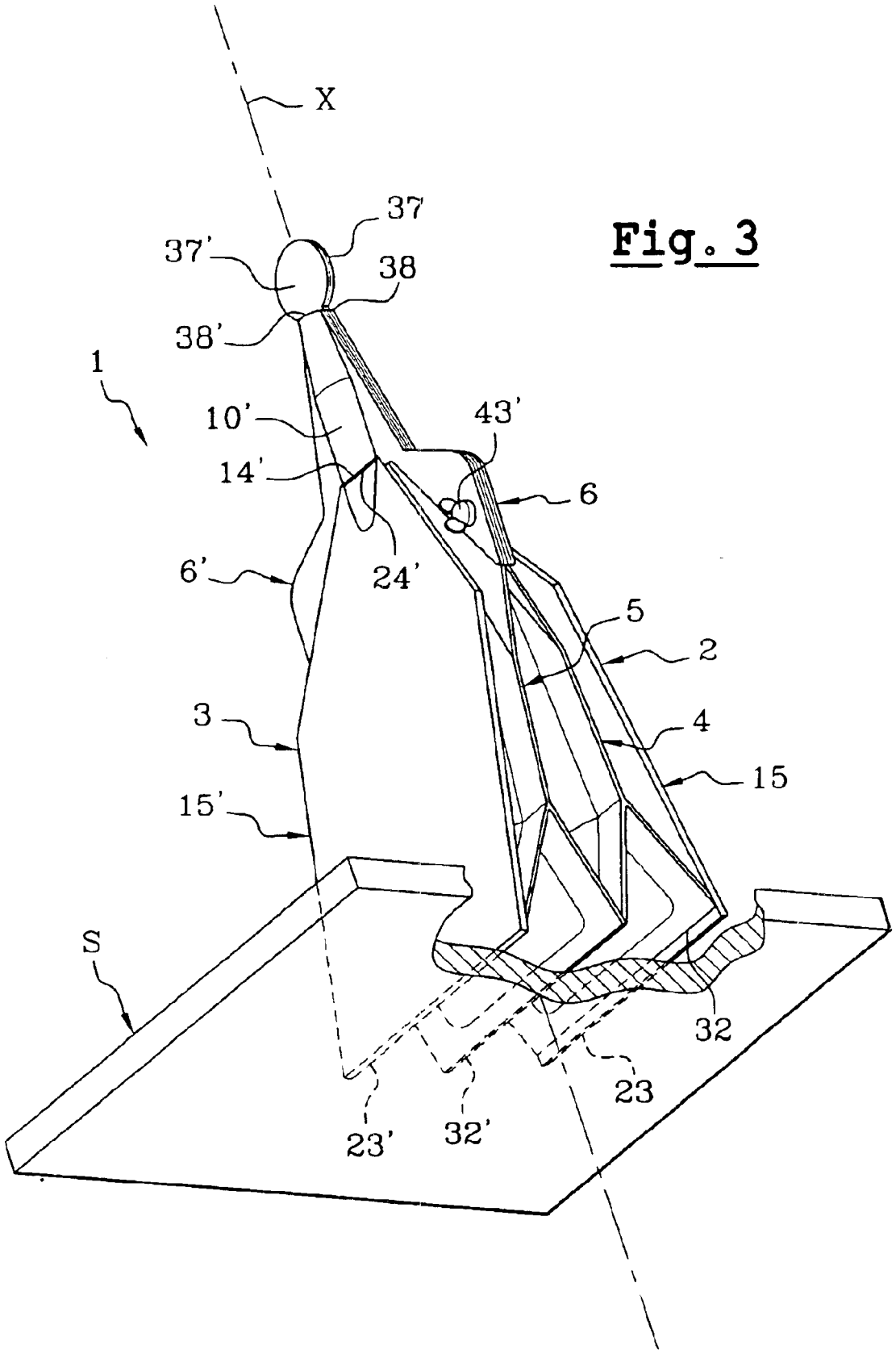
FIG. 3 is a perspective view of the device of FIG. 1 in the assembled position, resting on a horizontal work surface.
Figure 4:
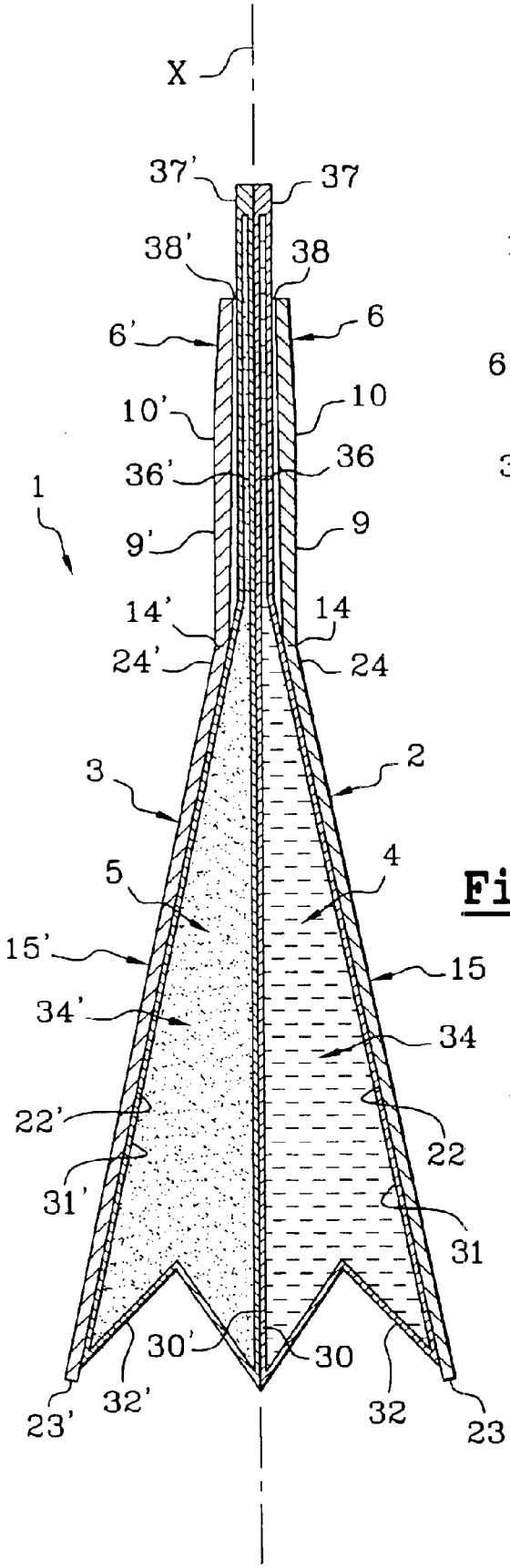
FIG. 4 is a view in longitudinal section of the device of FIG. 3.

The assembly thus formed is depicted in FIG. 3. In FIG. 3, the device 1, of longitudinal axis X, rests on the free end 23, 23' of the pressurizing plates 15, 15', which together may comprise an exemplary pressurizer. The free ends 23, 23' may project slightly beyond the bottom 32, 32' of the sachets 4 and 5. The collaboration between the two half-cylinders 9 and 9' of the elements 2 and 3, when arranged facing each other, may make it possible to define an end-piece of elongate shape that may allow localized application of the two products.

Figure 5A:
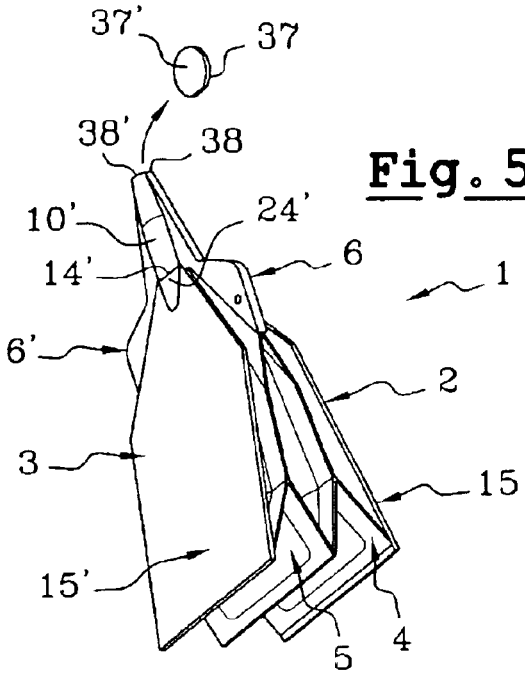

FIGS. 5A–5C depict an exemplary method of using the device 1.

As shown in FIG. 5A, the user may tear, for example, the end elements 37 and 37' of the sachets 4 and 5 so as to free their respective outlet orifices 38 and 38', which may lie one beside the other.

Next, as illustrated in FIG. 5B, she may take hold of the device 1 between the thumb and index finger and bring the end of the device 1 to the point at which she wishes to apply the two products, for example onto the hair. At that moment, she may exert pressure on the plates 15 and 15' so as to move them closer together. In doing so, the products contained separately in each of the sachets 4 and 5 may leave through the respective orifices 38 and 38', where they come into contact with one another. Mixing may occur directly at the point at which the products are applied.

After all of the product has been emptied, the plates 15 and 15' may be more or less in contact with one another, as depicted in FIG. 5C.

She can then remove the sachets 4 and 5, having beforehand unscrewed the nuts 43 and 43'. She may place the elements 2 and 3 in contact with water, for example, to clean them. The elements 2 and 3 may be kept with a view to being used later with two new sachets 4 and 5, which can be marketed separately from the device 1.

It will be apparent to those skilled in the art that various modifications and variations can be made to the structure and methodology described herein. Thus, it should be understood that the invention is not limited to the examples discussed in the specification. Rather, the present invention is intended to cover modifications and variations.

What is claimed is:

1. A device for simultaneously dispensing at least two products, each of the at least two products being packaged separately in at least first and second flexible-walled sachets, the device comprising:

a holder configured to fixedly hold the first and second sachets in superposed position so that respective outlet orifices of the first and second sachets are in the vicinity of one another; and a pressurizer movable with respect to the holder, the pressurizer being configured to apply pressure to the first and second sachets so as to force contents of the first and second sachets out through the respective outlet orifices in a predetermined ratio, wherein the pressurizer is coupled to the holder other than through the first and second sachets, and wherein the pressurizer is configured such that the pressure applied by the pressurizer presses the first and second sachets against each other.

2. The device of claim 1, wherein the pressurizer comprises at least two plates.

3. The device of claim 2, wherein the at least two plates are configured to articulate about an articulation axis with respect to the holder.

4. The device of claim 3, wherein the articulation axis is substantially perpendicular to a longitudinal axis of the device.

5. The device of claim 2, wherein the at least two plates substantially face one another and are each delimited by at least a pair of longitudinal edges.

6. The device of claim 5, wherein the device is configured so that the longitudinal edges of one of the two plates extend, over the entirety of their length, at a variable distance from corresponding longitudinal edges of the other of the at least two plates.

7. The device of claim 5, wherein the device is configured so that the longitudinal edges of one of the two plates extend, over the entirety of their length, in diverging manner away from corresponding longitudinal edges of the other of the at least two plates.

8. The device of claim 3, wherein each of the plates comprises a first end and a second end opposite to the first end, the first end being configured to be located in the vicinity of the outlet orifices and the first end being located adjacent the articulation axis.

9. The device of claim 8, wherein each of the two plates is coupled to the holder via an articulation region at the articulation axis.

10. The device of claim 9, wherein the two plates are coupled to the holder via a living hinge.

11. The device of claim 8, wherein the second end of each of the two plates is free.

12. The device of claim 10, wherein the living hinge is substantially perpendicular to a longitudinal axis of the device.

13. The device of claim 2, wherein the two plates are arranged substantially symmetrically on each side of a mid-plane of the device.

14. The device of claim 2, wherein the two plates are substantially similar.

15. The device of claim 2, wherein the holder comprises two fixing portions.

16. The device of claim 15, further comprising at least one fastening element configured to fasten the first and second sachets between the two fixing portions.

17. The device of claim 16, wherein the at least one fastening element is configured to reversibly fasten the first and second sachets between the two fixing portions.

18. The device of claim 16, wherein the at least one fastening element is configured to irreversibly fasten the first and second sachets between the two fixing portions.

19. The device of claim 16, wherein the at least one fastening element comprises at least one of a screw, a barbed element, and a rivet.

20. The device of claim 16, wherein the at least one fastening element comprises two fastening elements and each of the fixing portion defines a hole through which a corresponding one of the two fastening elements is configured to pass.

21. The device of claim 20, wherein each of the two fastening elements is configured to pass through corresponding holes in each of the first and second sachets.

22. The device of claim 20, wherein each of the two fastening elements is located on opposite sides of a central longitudinal axis of the device.

23. The device of claim 16, wherein the at least one fastening element is secured to one of the two fixing portions.

24. The device of claim 20, wherein each of the two fastening elements is secured to a corresponding one of the two fixing portions.

25. The device of claim 2, wherein each of the two plates comprises a portion of an end-piece extending along a longitudinal axis of the device.

26. The device of claim 25, wherein the end-piece is configured to convey product from each of the first and second sachets to a desired location.

27. The device of claim 25, wherein one of the two plates comprises, on at least one part of the length of the end piece, an axial bulge.

28. A system for simultaneously dispensing at least two products, the system comprising:

the device of claim 1; and at least first and second flexible-walled sachets fixedly held by the holder.

29. The system of claim 28, wherein each of the at least first and second sachets is configured to be opened by at least one of cutting, tearing, and breaking a respective end portion of each sachet.

30. The system of claim 28, wherein the pressurizer comprises first and second pressurizing plates between which the at least first and second sachets are superposed.

31. The system of claim 30, wherein said first and second pressurizing plates are arranged substantially symmetrically on each side of a mid-plane situated at an interface between the at least first and second sachets.

32. The system of claim 30, wherein each of the at least first and second sachets comprises a respective outlet orifice, and wherein a first end of each of the first and second pressurizing plates, in the vicinity of said outlet orifices, is coupled to the holder via an articulation region.

33. The system of claim 32, wherein a second end of each of said first and second pressurizing plates, opposite the first end of each of said first and second plates, is free such that the second end of each of said first and second plates is movable to bring the first and second plates closer together to pressurize said at least first and second sachets in a substantially equal manner.

34. The system of claim 30, wherein each of the plates is formed from an identical mold.

35. The system of claim 28, wherein each of the at least first and second sachets comprises a respective outlet orifice, and wherein the system is configured to rest freely on a substantially horizontal support with said outlet orifices a distance from said horizontal support.

36. The system of claim 35, wherein the system is configured to rest substantially vertically on said support.

37. The system of claim 28, wherein each of the at least first and second sachets comprises an end portion configured to extend beyond the holder.

38. The system of claim 28, wherein each of the at least first and second sachets comprises two sheets, each sheet delimiting a respective sachet main face.

39. The system of claim 38, wherein each of the at least first and second sachets further comprise a third sheet forming a sachet bottom.

40. The system of claim 28, wherein at least one of the at least first and second sachets comprises a complex of aluminum and a plastic capable of being thermally welded to itself.

41. The system of claim 28, wherein each of the first and second sachets contains a component of a cosmetic composition.

42. The system of claim 40, wherein the cosmetic composition comprises a hair composition.

43. A method of dispensing at least two products, comprising:

providing the system of claim 28;

pressurizing each of the first and second sachets to cause a first product to flow from the first sachet and a second product to flow from the second sachet.

44. The method of claim 43, further comprising combining the first and second products to form a cosmetic composition.

45. The method of claim 44, wherein the cosmetic composition comprises a hair product.

46. The method of claim 45, further comprising applying the hair composition to hair.

47. The method of claim 46, wherein the hair composition comprises a hair dying composition.

48. The method of claim 43, wherein the pressurizing comprises pressing at least one pressurizing plate to exert pressure on the first and second sachets.

49. The method of claim 48, wherein the pressurizing comprises moving a free end of a first pressurizing plate closer to a second pressurizing plate to exert pressure on the first and second sachets.

50. A device for simultaneously dispensing at least two products, each of the at least two products being packaged separately in at least first and second flexible-walled sachets, the device comprising:

a first element comprising a first fixing part and a first pressurizing plate movable with respect to the first fixing part in a direction transverse to a mean plane of the first plate;

a second element comprising a second fixing part and a second pressurizing plate movable with respect to the second holding part in a direction transverse to a mean plane of the second plate; and at least one fastening element configured to fixedly hold the first and second sachets in a superposed position between the first and second elements.

51. The device of claim 50, wherein the device is configured so that a main face of the first sachet contacts an internal face of the first pressurizing plate and a main face of the second sachet, opposite the main face of the first sachet, contacts an internal face of the second pressurizing plate.

52. The device of claim 50, wherein the device is configured so that when the sachets are in position between the first and second elements, an end portion of each of the sachets extends beyond the first and second fixing parts to allow the sachets to be opened.

53. A system comprising the device of claim 52 and first and second flexible-walled sachets, wherein the sachets are configured to be opened by one of tearing, cutting, and breaking of the end portion.

54. The device of claim 50, wherein the first and second fixing parts form an end-piece directed along a longitudinal axis of the device.

55. The device of claim 54, wherein the end-piece is configured to allow application of product contained in the sachets to a desired location.

56. The device of claim 54, wherein at least one of the first and second fixing parts forms, on at least part of the length of the end piece, an axial bulge.

57. A system comprising the device of claim 56 and first and second flexible-walled sachets, wherein each of the sachets delimits an outlet duct opening on one end to an outlet orifice and on another end into a larger width portion forming a sachet reservoir.

58. The system of claim 57, wherein the axial bulge is configured to facilitate communication between the outlet orifices of the sachets and their respective reservoirs via their respective outlet ducts.

59. The device of claim 50, wherein the first and second pressurizing plates are pivotable with respect to the first and second fixing parts, respectively, about an articulation region.

60. The device of claim 59, wherein the articulation region is oriented approximately perpendicular to a longitudinal axis of the device.

61. The device of claim 60, wherein the articulation region of each of the first and second elements comprises a living hinge.

62. The device of claim 60, wherein the articulation region of each of the first and second elements is delimited by first and second cuts in the first and second elements, respectively.

63. The device of claim 62, wherein the first and second cuts of each of the first and second elements extend at an angle with respect to an articulation axis defined by the articulation region and with respect to the longitudinal axis.

64. The device of claim 63, wherein the first and second cuts open onto respective longitudinal edges of the first and second elements.

65. The device of claim 50, wherein the at least one fastening element is configured to allow the sachets to be reversibly assembled on the device.

66. The device of claim 50, wherein the at least one fastening element is configured to allow the sachets to be irreversibly assembled on the device.

67. The device of claim 50, wherein the at least one fastening element passes through holes defined by the sachets and by at least one of the first and second fixing parts.

68. The device of claim 67, wherein the device is configured such that the holes defined by the sachets and the at least one fixing part are configured to be aligned with one another.

69. The device of claim 67, wherein the fastening element comprises at least one of a screw, a barbed element, and a rivet.

70. The device of claim 67, wherein the at least one fastening element is fixedly attached to at least one of the first and second fixing parts.

71. The device of claim 67, wherein the device is configured such that the first and second sachets and the first and second fixing parts each form two shoulders, one shoulder situated on each side of a longitudinal axis of the device, and wherein at least one fastening element is located on each side of the longitudinal axis at each of the shoulders.

72. The device of claim 70, wherein at least one fastening element is fixedly attached to the first fixing part and at least one fastening element is fixedly attached to the second fixing part.

73. The device of claim 50, wherein the device is configured so that, at least prior to opening outlet orifices of the sachets, the first and second pressurizing plates diverge from each other in a direction away from the outlet orifices.

74. The device of claim 73, wherein a free end of each of the pressurizing plates extends beyond a bottom of the first and second sachets.

* * * * *

UNITED STATES PATENT AND TRADEMARK OFFICE

CERTIFICATE OF CORRECTION

PATENT NO. : 6,889,870 B2
DATED : May 10, 2005
INVENTOR(S) : Vincent De Laforcade It is certified that error appears in the above-identified patent and that said Letters Patent is hereby corrected as shown below:

Column 12,
Line 21, "portion" should read -- portions --.

Signed and Sealed this

Nineteenth Day of July, 2005

JON W. DUDAS
*Director of the United States Patent and Trademark Office*